US007050711B2

(12) United States Patent
Garver

(10) Patent No.: US 7,050,711 B2
(45) Date of Patent: May 23, 2006

(54) MODERATING DEVICE FOR AN ELECTRIC STOVE HEATING ELEMENT

(75) Inventor: Peter Garver, Lakewood, OH (US)

(73) Assignee: PBG02, Inc., Canfield, OH (US)

( * ) Notice: Subject to any disclaimer, the term of this patent is extended or adjusted under 35 U.S.C. 154(b) by 116 days.

(21) Appl. No.: 10/938,360

(22) Filed: Sep. 10, 2004

(65) Prior Publication Data

US 2006/0056825 A1 Mar. 16, 2006

(51) Int. Cl.
*F28D 7/00* (2006.01)

(52) U.S. Cl. ..... 392/496; 219/443.1

(58) Field of Classification Search ..... 392/465–496; 219/443.1; 126/1

See application file for complete search history.

(56) References Cited

U.S. PATENT DOCUMENTS 3,711,681 A * 1/1973 Leuschner et al. ..... 392/467
4,460,819 A * 7/1984 Eugster ..... 392/484
4,480,176 A * 10/1984 Raskov ..... 219/463.1
4,553,025 A * 11/1985 Raskov ..... 219/463.1
5,367,607 A * 11/1994 Hufnagl et al. ..... 392/465
6,327,429 B1 * 12/2001 Chan ..... 392/483
6,816,670 B1 * 11/2004 Renau ..... 392/467

* cited by examiner

*Primary Examiner*—Thor S. Campbell
(74) *Attorney, Agent, or Firm*—Robert G. Lev

(57) ABSTRACT

A system and a method of operating that system are used to quickly adjust the temperature of an electric stove heating element. A heat transfer or moderating fluid is pumped through a hollow portion of an electric stove heating element. The moderating fluid is heated or cooled to an appropriate temperature, and inserted under the control of a microprocessor to more quickly modify the temperature of the stove heating element. The system allows rapid temperature changes in normally sluggish electric stove heating elements. Also, accurate temperature adjustment is permitted by the microprocessor controlled.

14 Claims, 12 Drawing Sheets

Temperature

T1-"Hot" fluid
T2-"Cold" fluid
T3-Heating Element

Valves
V1-Send valve position
V2-Return valve position
V3-One way valve Position Flow Rate
F1-"Hot" Return Rate
F2-"Cold" Return Rate
F3-"Hot" Send Rate
F4-"Cold" Send Rate

MODERATING DEVICE FOR AN ELECTRIC STOVE HEATING ELEMENT

FIELD OF THE INVENTION

The present invention is related generally to the field of electric cooking stove elements. In particular, the present invention is related to a device and system for moderating temperature enhancing the speed and precision of electric stove cooking elements.

BACKGROUND OF THE INVENTION

Cooking stoves with electric elements are well-known, and used in a variety of configurations and models. The popularity of electric cooking stoves is well-found. Electric stoves operate without an open flame, and so, are much safer and less vulnerable than any device using an open flame. Further, there is no chance of a gas leak as there is with natural gas cooking stoves. The electric heating elements are easily repaired in an operation that is much more easily managed than the relatively complex repair and replacement of the various parts of a gas stove burner.

However, many cooks prefer a natural gas cooking stove over an electric cooking stove. The reason is that natural gas permits a wide range of applied heat to be controlled virtually instantaneously. In contrast, electric cooking stoves change temperature relatively slowly. For a skilled cook, who must exert precise control when manipulating complex recipes, the slow changes of an electric cooking stove are unacceptable. Even if the delicacy of heat control is not an issue, there is considerable aggravation entailed in the time delay necessary for electric heating elements to reach the desired temperatures. Likewise, electric heating elements cool down so slowly that it is often necessary to remove the cooking vessels in order to avoid overcooking due to the residual heat from the electric heating element.

The precise, near-instantaneous heat adjustments of a gas cooking element is simply not available in conventional electrical cooking stoves. Accordingly, there is a need for an electric cooking stove heating element that admits to far faster temperature adjustment than is possible conventionally. Further, there is also a need for precise temperature adjustment for electric cooking stove. Preferably, both of these attributes would be combined in the more desirable improvements for electric cooking stoves.

SUMMARY OF THE INVENTION

Accordingly, it is a first object of the present invention to provide an electric heating element for a cooking stove which avoids the drawbacks of conventional electric cooking stove heating elements.

It is another object of the present invention to provide an electric heating element in which temperature can be more precisely controlled than is possible with conventional electric heating elements.

It is a further object of the present invention to provide an electric heating element that can be more rapidly heated and more rapidly cooled than conventional electric cooking elements.

It is an additional object of the present invention to provide an electric heating element that admits to precise computer control.

It is still another object of the present invention to provide an electric heating element that can be set at an immediate starting temperature.

These and other goals and objects of the present invention are achieved by an electric heating element having a conductor connected to an external electric power source. The heating element has a hollow cross-sectional portion extending along the length of the heating element. This hollow portion is configured to contain and carry a heat transfer liquid that is inserted into the heating element.

Another manifestation a system for controlling heating, at least one electric stove heating element is used. The electric heating element is energized by an external electric power source, and has a hollowed out portion and an integral electric conductor connected to the external electric power source. The power provided to the integral electric conductor provides energy to be converted into heat. The system includes at least one reservoir containing a heat transfer fluid. The system also contains a handling mechanism for moving the heat transfer fluid from the reservoir through the hollow portion and back through the reservoir.

Another manifestation of the present invention is directed to a method of adjusting temperature of an electric stove heating element, which is energized by a primary external power source. Temperature is moderated by an external temperature-controlled heat transfer fluid. In operation, a user selects a desired temperature for the heating element. Power from the primary external electric power source is adjusted to alter temperature of the heating element. Also, the heat transfer fluid is provided to the heating element to further alter its temperature. The altered temperature is detected and compared to the desired temeperature to determine if additional adjustment is necessary.

DETAILED DESCRIPTION OF THE PREFERRED EMBODIMENTS

Figure 1:
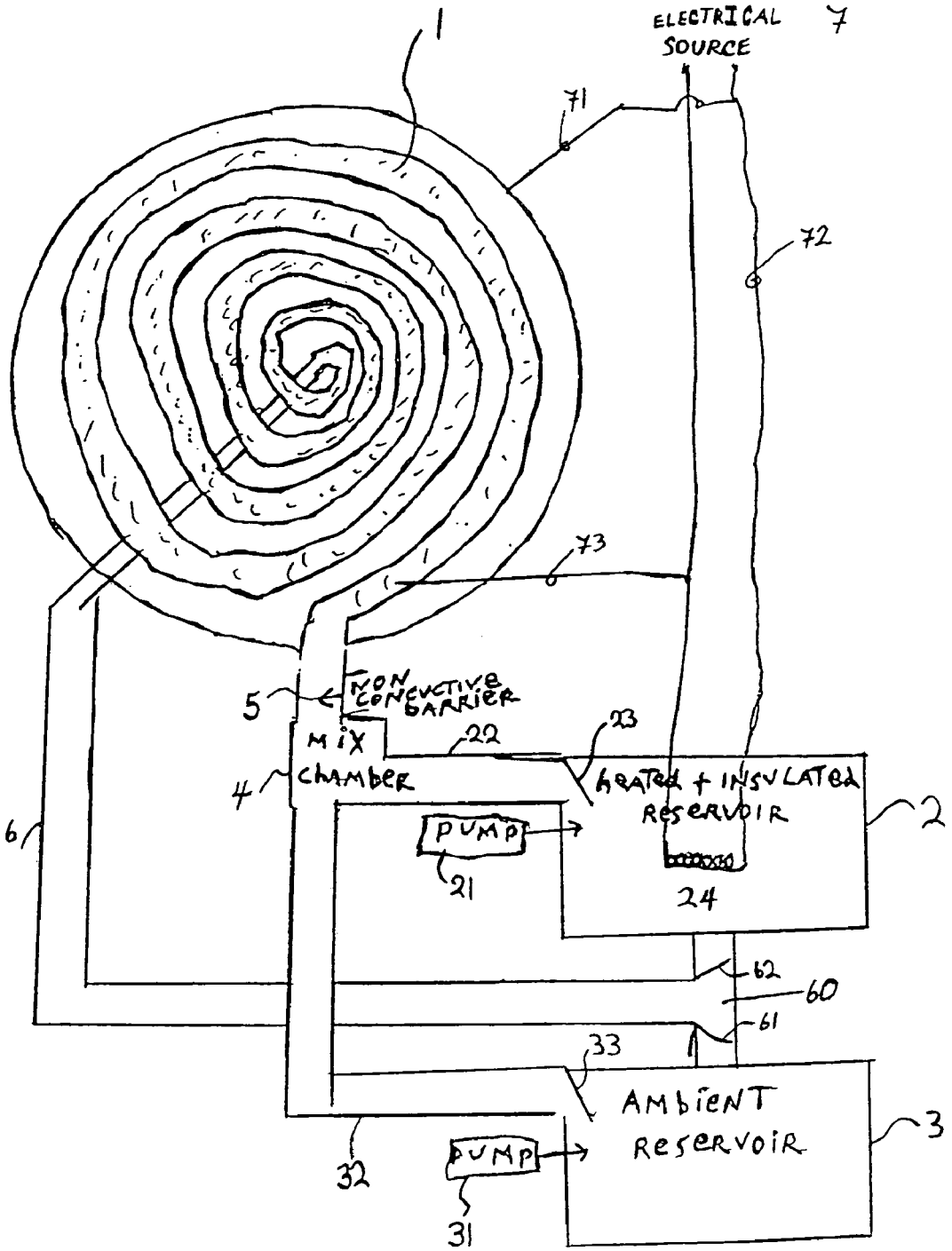
FIG. 1 is a representative diagram encompassing the entire system of the present invention.

The present invention is a system for using a moderating heat transfer fluid within a modified electric stove heating element. FIG. 1 depicts an environment containing one embodiment of the present inventive system. The electric "burner" or heating element 1 is very similar to that on a conventional electric stove. However, it has been modified in accordance with any one of FIG. 10, 11 or 12. The heating element 1 is provided with power from an external electrical power source 7, through lead line 71 and return line 73.

In addition, an auxiliary heater 24 is provided for a heated fluid reservoir 2. A cool fluid or ambient reservoir 3 is also included in this variation of the inventive system. A mixing chamber 4 is used to mix the heat transfer fluids from the two reservoirs before entering the heating element 1. The mixing chamber is provided with a non-conductive barrier 5 to protect it from the direct heat of the heating element 1. Lead lines 22 and 32 provide access to the mixing chamber 4 from the two reservoirs 2, 3. Flow of fluid from each of the two reservoirs is controlled by valves 23 and 33, respectively.

Heated reservoir 2 is provided with a pump 21 to force heated fluid into the mixing chamber 4 via valve 23 and access line 22. Likewise, ambient reservoir 3 has a pump 31 to force cool fluid into mixing chamber 4 via valve 33 and into access line 32. These pumps can be controlled manually, but are preferably controlled by a processor 200 (as in FIG. 9).

Heated reservoir 2 can be heated in any number of different ways. The embodiment of FIG. 1 uses an auxiliary heater 24, which is fed from the main power source 7, which feeds heating element 1. However, other methods of heating can be used. Any specific design would depend upon the extent and speed of rapid heating desired, as well as the overall permitted cost of the stove.

Likewise, the cooling of cool fluid reservoir 3 can be as simple or as complex as desired for the particular electric stove (or other cooking/heating device) in which the present invention is to be installed. The simplest method is simply through the use of ambient cooling, as is done in the embodiment of FIG. 1. However, a refrigeration unit could also be used. Also, circulating cold water can be used to lower the temperature of ambient fluid reservoir 3 to well below that of the ambient air. Any known method of cooling can be used to lower the temperature of reservoir 3, when practical.

Both of the reservoirs 2, 3 can be insulated for greater efficiency. It is preferable that the ambient reservoir 3 be located well separated from any source of heat (such as the heating element 1 and the heated reservoir 2) in order to keep the fluid of reservoir 3 from being heated either through conduction or convection. The pumps 21 and 31 can also be arranged so that they do not add heat to the system, other than where it is desired.

The circulation of the heat transfer fluid 15 (in FIGS. 10–12) from the reservoirs 2, 3 into the heating element 1 is completed by return line 6. This return line dead-ends in a chamber 60 which feeds both of the reservoirs 2, 3. The return flow into each of the reservoirs is controlled by valves 61, 62, respectively. The return chamber 60 can be of any shape or configuration necessary to service both of the reservoirs 2, 3.

Figure 10:
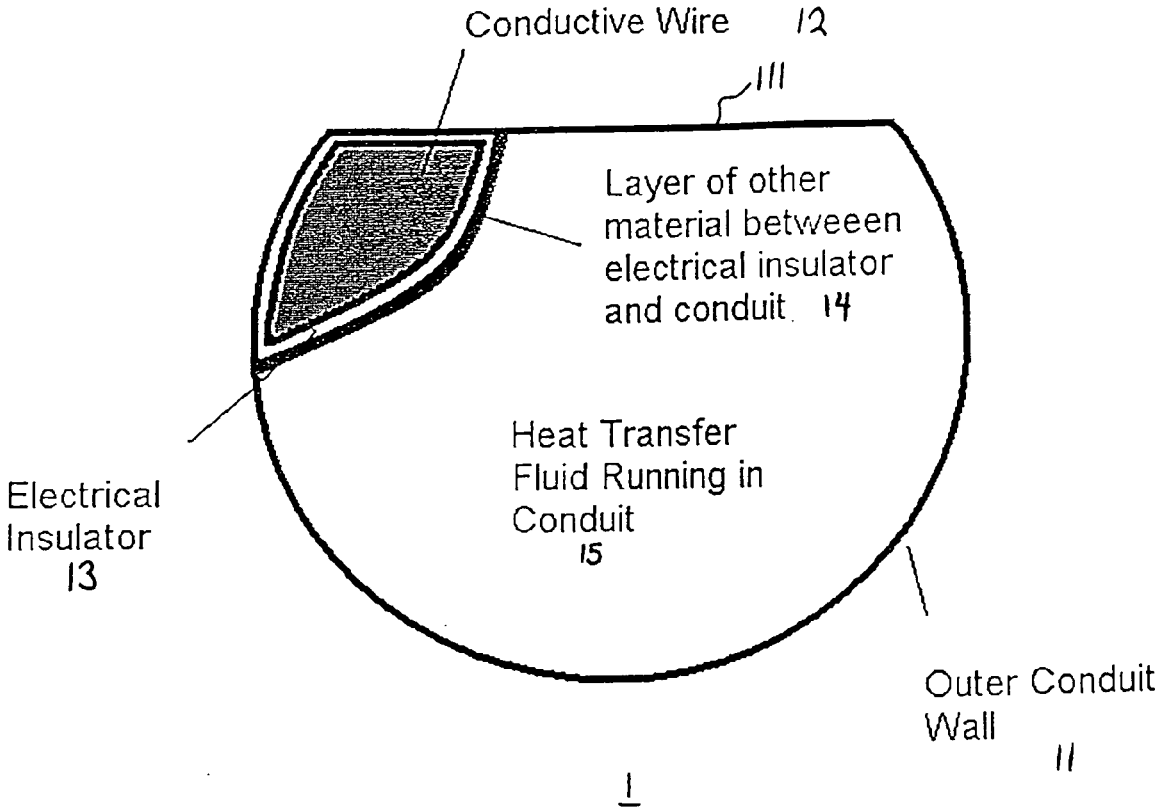
FIG. 10 is a cross-sectional diagram of a typical heating element configured in accordance with the present invention.
Figure 11:
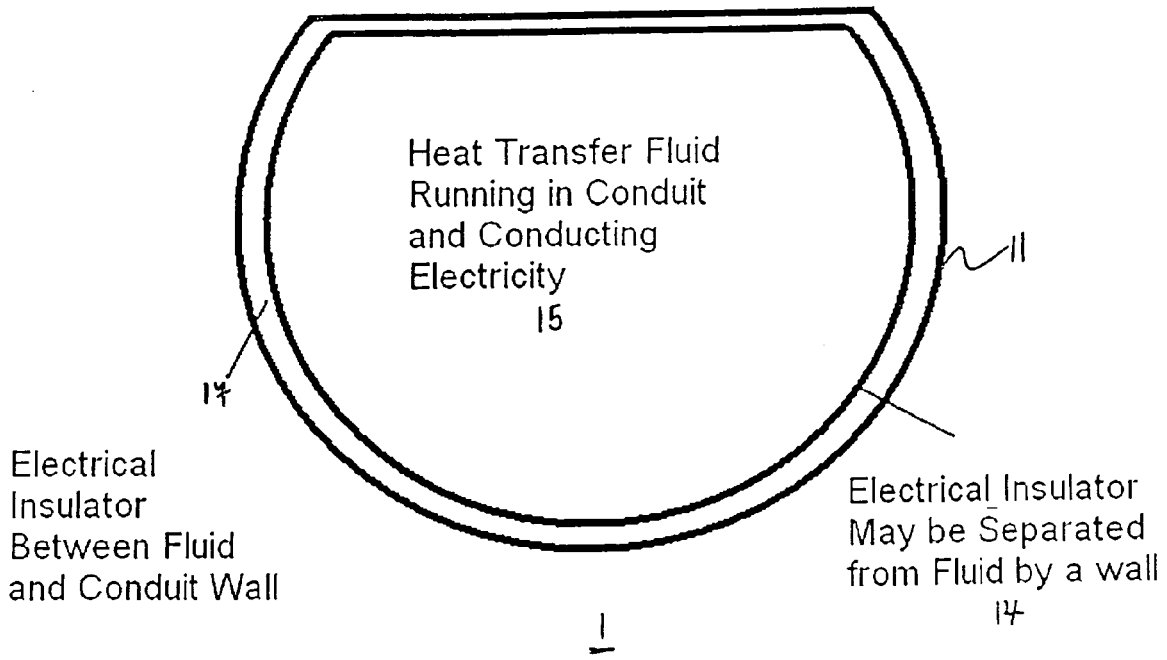
FIG. 11 is a cross-sectional diagram of an alternative heating element configured in accordance with the present invention.
Figure 12:
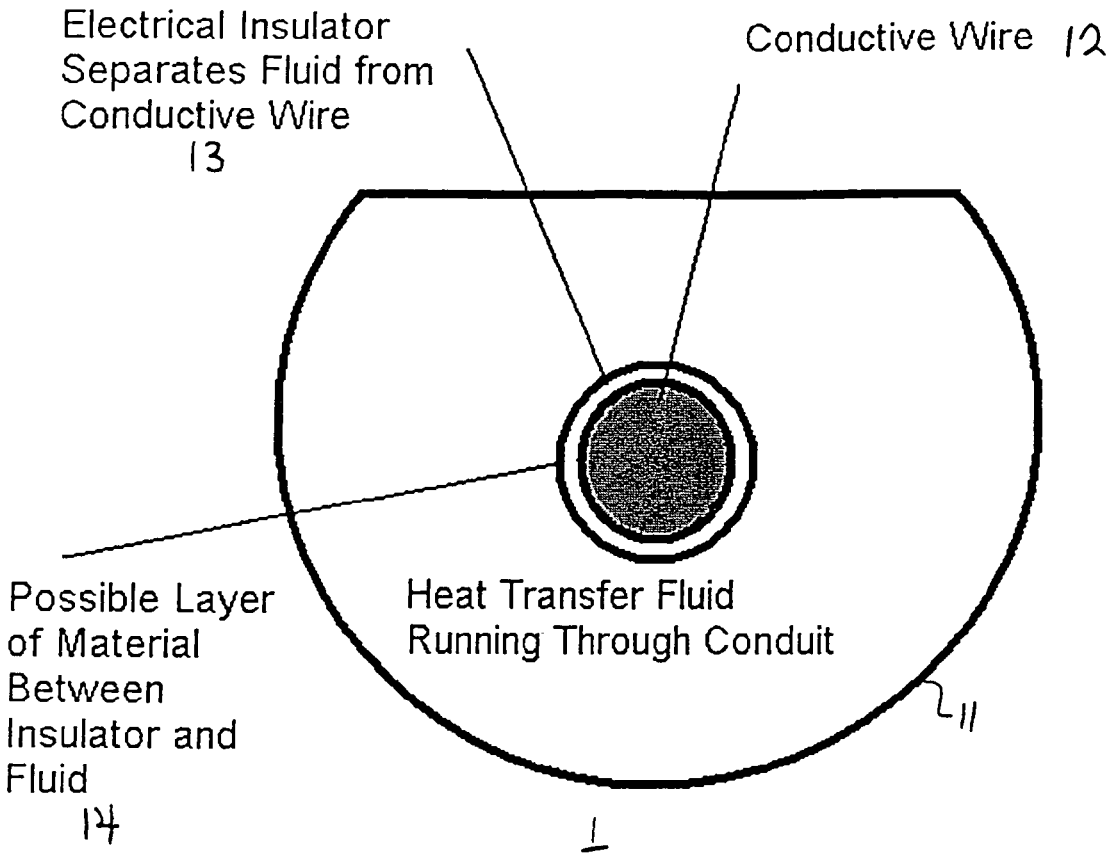
FIG. 12 is a cross-sectional diagram depicting a second alternative of a heater configured in accordance with the present invention.

A key aspect in the present invention is illustrated in FIGS. 10, 11, and 12. These drawings depict inventive modifications in the heating element 1, which distinguish the present invention from conventional electric heating elements. A first embodiment is depicted in FIG. 10, which is a cross-sectional view of heating element 1. The heating element is heated by a conductive wire 12 in a conventional manner. The wire is fed via lead 71 from power source 7, and connected to return line 73 to complete the electrical circuit needed. The conductive wire 12 is contained by electrical insulator 13, and further segregated from the rest of heating element 1 by an additional insulator 14. This insulator is configured to separate the electrical wire 12 from heat transfer fluid 15 that will be flowing through the electrical heating element 1. It should be understood that the heating element 1 is formed as a hollow fluid conduit surrounded by an outer wall 11. The top surface 111 of the outer conduit wall is flattened to better accommodate cooking vessels.

FIG. 11 depicts the cross-sectional view of an alternative heating element 1. The outer conduit wall 11 is supplemented by an electrical insulator 17, between the outer wall and the heat transfer fluid 15. This particular embodiment is designed so that the heat transfer, or moderating fluid 15 is conductive. Appropriate electrodes from lead 71 and return line 73 are placed in the heat transfer fluid is so that the power that would be conveyed on conductive wire 12 is now conveyed through the fluid to power heating element 1. Because of the electrical conduction of the fluid, an additional insulator 17 may be considered necessary. The use of the FIG. 11 embodiment (relying upon the heat transfer fluid to conduct main power through the electric heating element 1) entails a certain number of complications, and so may not be appropriate for all electric heating applications.

A further embodiment is depicted by the cross-sectional view of FIG. 12. In this arrangement, the conductive wire 12 (for heating the electric heating element 1) is surrounded by an electrical insulator 13, and possibly an additional fluid-proof layer 14 to ensure that the moderating or heat transfer fluid does not degrade either the insulator 13, or touch conductive wire 12.

It should be understood that heating element 1 is similar in many respects to conventional heating element designs. These are made of metal or ceramic, which are often hollowed out to contain a conductive wire to carry the power used for heating. However, conventional heating elements are not appropriate for use with the present invention unless they are substantially modified so as to contain the heat transfer fluid 15. This means that the insulating and fluid containment layers depicted in FIGS. 10–12 must be added. Also, ports (not shown) for the entrance and the exit of the heat transfer fluid 15 must also be added. Accordingly, there are substantial difficulties in retrofitting conventional heating element designs. However, such retrofitting would fall within the concept of the present invention.

It should be noted the exact shape of the cross-section is not significant, and can be altered based upon manufacturing concerns and the desired configuration for the cooking top or heating element application. As a result, almost any configuration can be used for the cross-section of heating element 1.

The heat transfer or moderating fluid that runs through the heating element 1 can consist of any number of different materials. Virtually any kind of material can be used depending upon the duty cycle and temperatures used by the heating element 1. Water is a well-known heat transfer fluid. Further, saltwater serves as an excellent conductor if the ionization levels are sufficiently high. Any fluid that is capable of sufficiently high ionization can also be used as an electrical conductor (for the FIG. 11 embodiment).

In some cases, it is better to have a highly dielectric material as a transfer fluid. One example is silicon dielectrics, which are available in a wide range of specifications. Mineral oils could also be used in low-temperature applications. Mercury is also a possibility, but must be kept in a fully closed or contained system. PCBs (such as Pyranal or Askeral) also provide technically workable solutions. However, they must also be kept in closed systems, and might pose some licensing and disposal problems. Virtually any fluid appropriate for a particular duty cycle or desired temperature range can be used.

Figure 2:
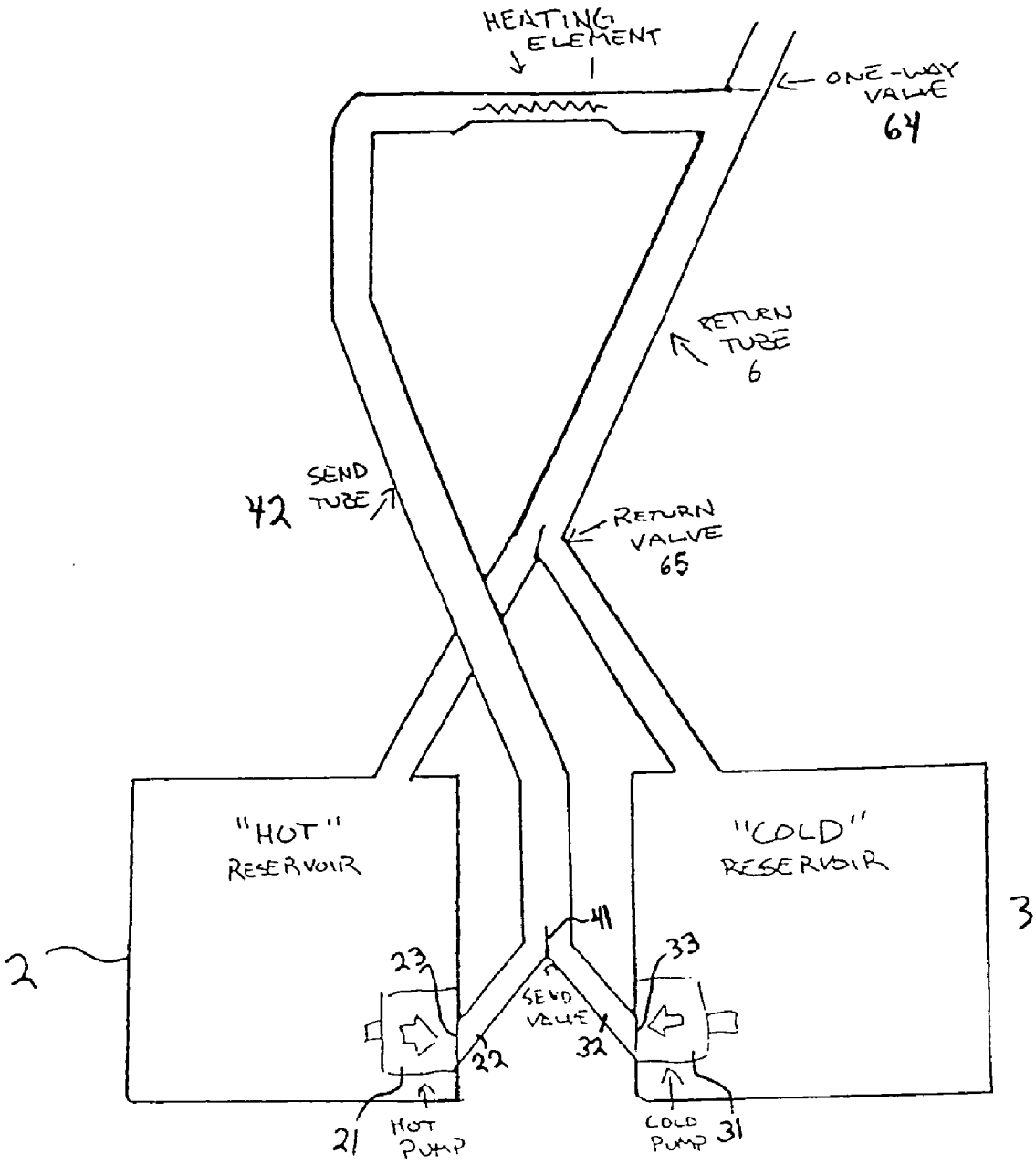
FIG. 2 is a schematic diagram of the heat transfer or fluid circulation system with an open (to the atmosphere) configuration.

FIG. 2 depicts a schematic of a heat transfer fluid distribution system, applying temperature control to heating element 1. In this embodiment, water is used in the hot reservoir 2, and can be kept between 200 and 300° C. through the use of an electric a heating element 24, arranged in the reservoir 2 or adjacent thereto. The hot reservoir 2 is preferably insulated to prevent loss of heat by convection to the rest of the system or by conduction through feeder tube 22 or return tube 6. The cold reservoir 3 also contains water, which is normally kept at ambient temperature. However, if greater cooling capacity is required, the water can be cooled by various types of well-known refrigeration means, and cold reservoir 3 can be insulated from the ambient air or any other sources of heat.

The embodiment of FIG. 2 is somewhat more developed than that depicted in FIG. 1, and uses additional valves. For example, send valve 41 controls fluid from both the feed line 22 from reservoir 2 and the feed line 32 from reservoir 3. Send tube 42 carries the heat transfer fluid selected by send valve 41 into heating element 1. Return tube 6 permits return of the fluid from the heating element. The reservoir to which the fluid is returned is determined by return valve 65. In order for the correct valve selection to be made, the embodiment of FIG. 2 is preferably controlled by a processor 200 (in FIG. 9). However, the selection of valve position for send valve 41 and return valve 65 can be made manually by the user.

FIG. 2 depicts an open system in which heat transfer fluid need not be flowing throughout the heating element 1 and circulation system (send tube 42 and return tube 6) on a constant basis. Rather, air or additional fluid can be introduced into the circulating system. This is done by one-way valve 64. In the open system there will be times when some of the various tubes are entirely empty, and the entire system is at atmospheric pressure.

When the heating cycle requires, hot fluid from reservoir 2 is forced through heating element 1 using pump 21. The operation of pump 21, valve 23 and send valve 41 are all controlled in response to a request to heat or augment the heat of heating element 1. When enough heat transfer fluid 15 has been pumped into the heating element 1 to fill it, the fluid returns from the heating element via return tube 6.

Figure 4:
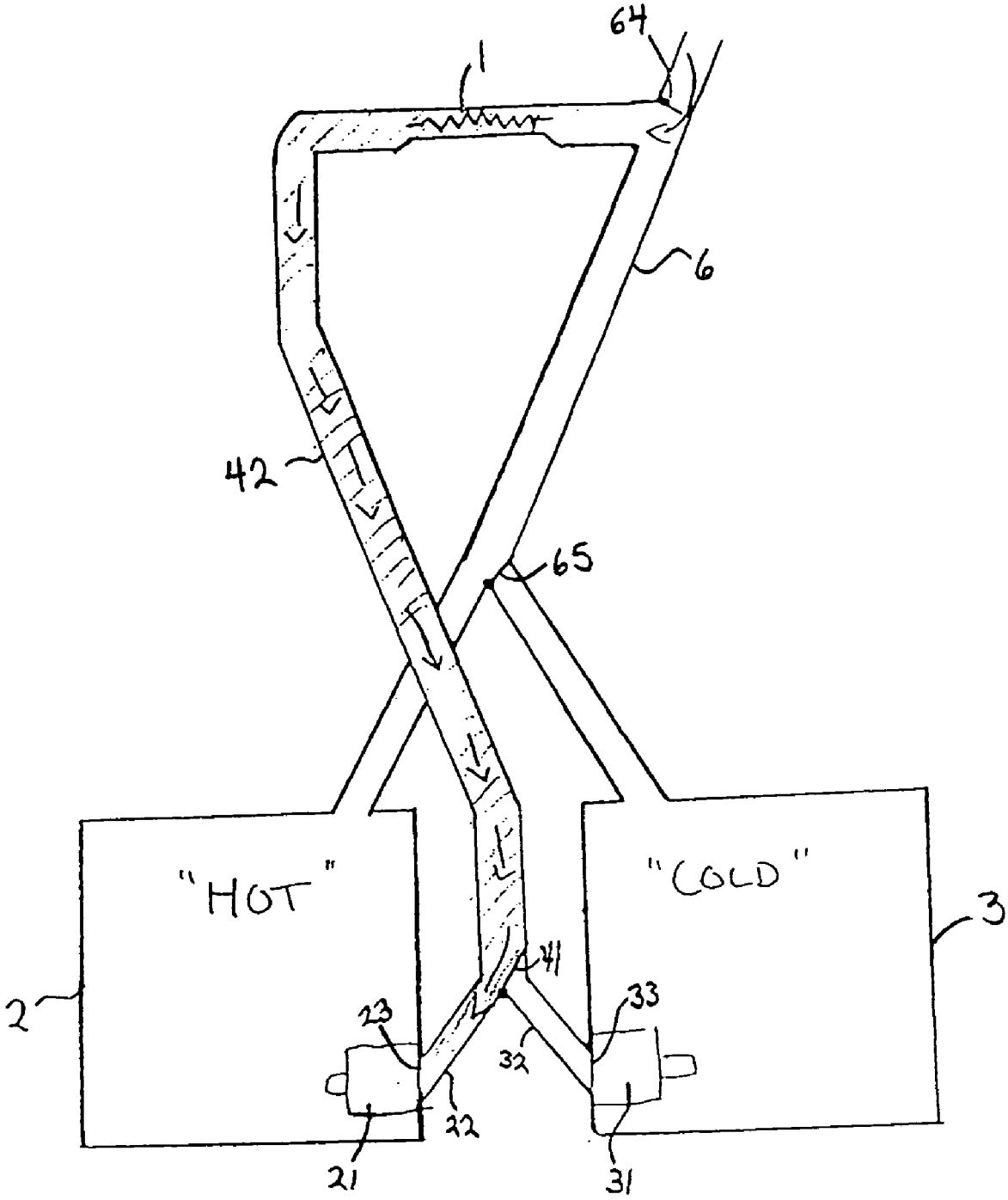
FIG. 4 is a schematic diagram of the heat transfer fluid circulating system in an open configuration, and depicting the flow of hot moderating fluid based upon a gravity return operation.

However, one-way valve 64 will also allow air to be pulled into the heating element if the pressure at that part of the system is lower than atmospheric pressure. Thus, when the pump 21 is stopped, if the fluid in the send tube 42 coming from reservoir 2 is at a lower height than the heating element 1, a negative pressure will be created and air will be drawn in through valve 64 as the fluid falls back to the reservoir 2. This flow is depicted in FIG. 4, which includes an open one-way valve 64, permitting air to enter the heating element 1. Because of the air pressure, and gravity, the flow of the moderating fluid will be as shown in FIG. 4. Send valve 41 will be directed automatically (via processor 200 control) to take the position depicted in FIG. 4 so that the fluid may flow back into reservoir 2. Valve 23 will also be automatically operated to accommodate the flow back into reservoir 2.

Figure 6:
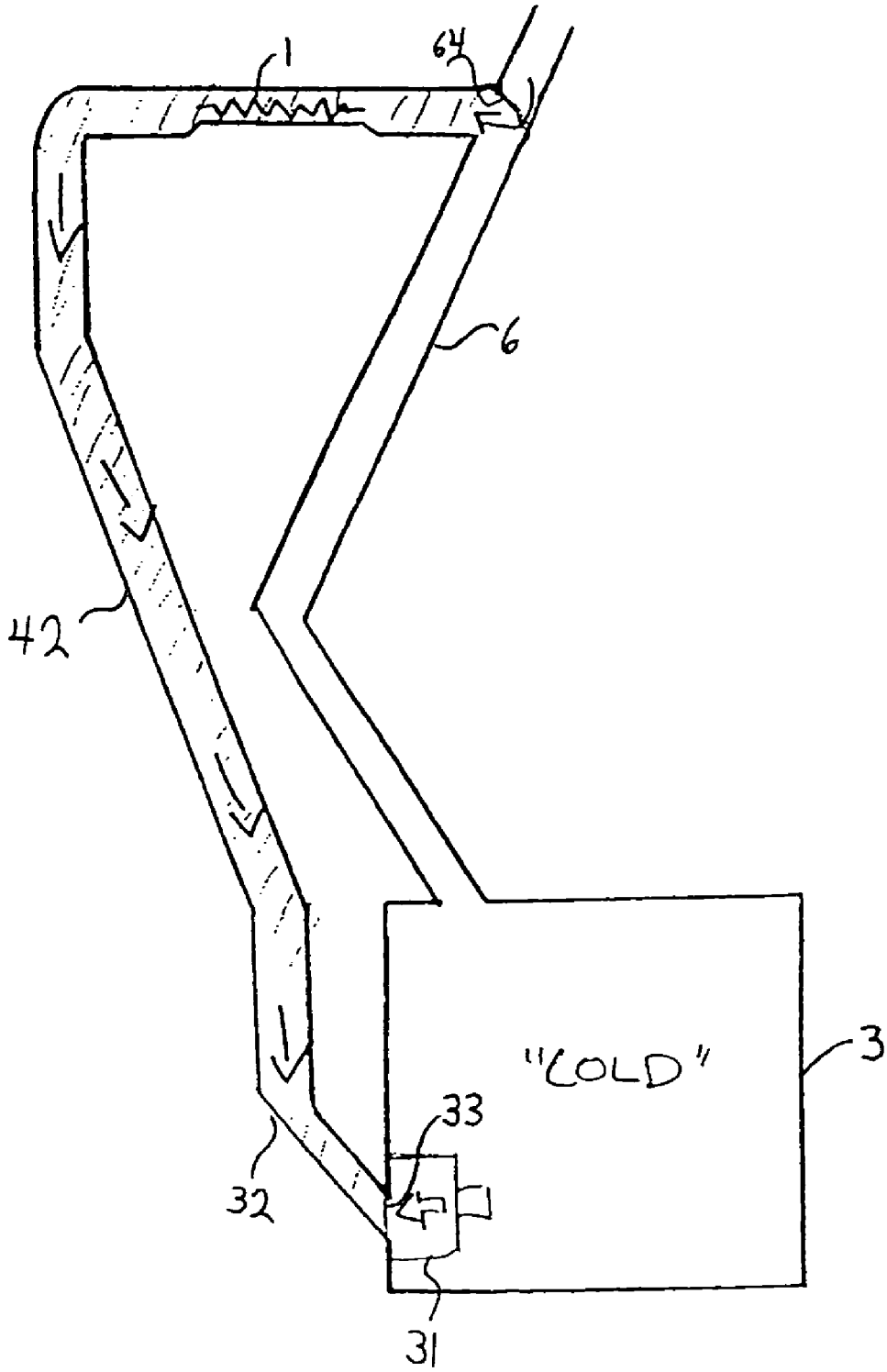
FIG. 6 is a schematic diagram of the heat transfer fluid circulating system for only cold heat transfer fluid in an open configuration, depicting gravity return operation.

The same operation using heat transfer fluid is from cold reservoir 3 is depicted in FIG. 6. In this case, the only difference from the operation depicted in FIG. 4 is that send valve 41 had been placed in a different position, blocking flow to hot reservoir 2, and forcing the fluid back into cold reservoir 3 via valve 33. As in the operation of FIG. 4, the operation of FIG. 6 depends upon gravity with both reservoirs 2, 3 being placed physically in a lower position than heating element 1.

Figure 5:
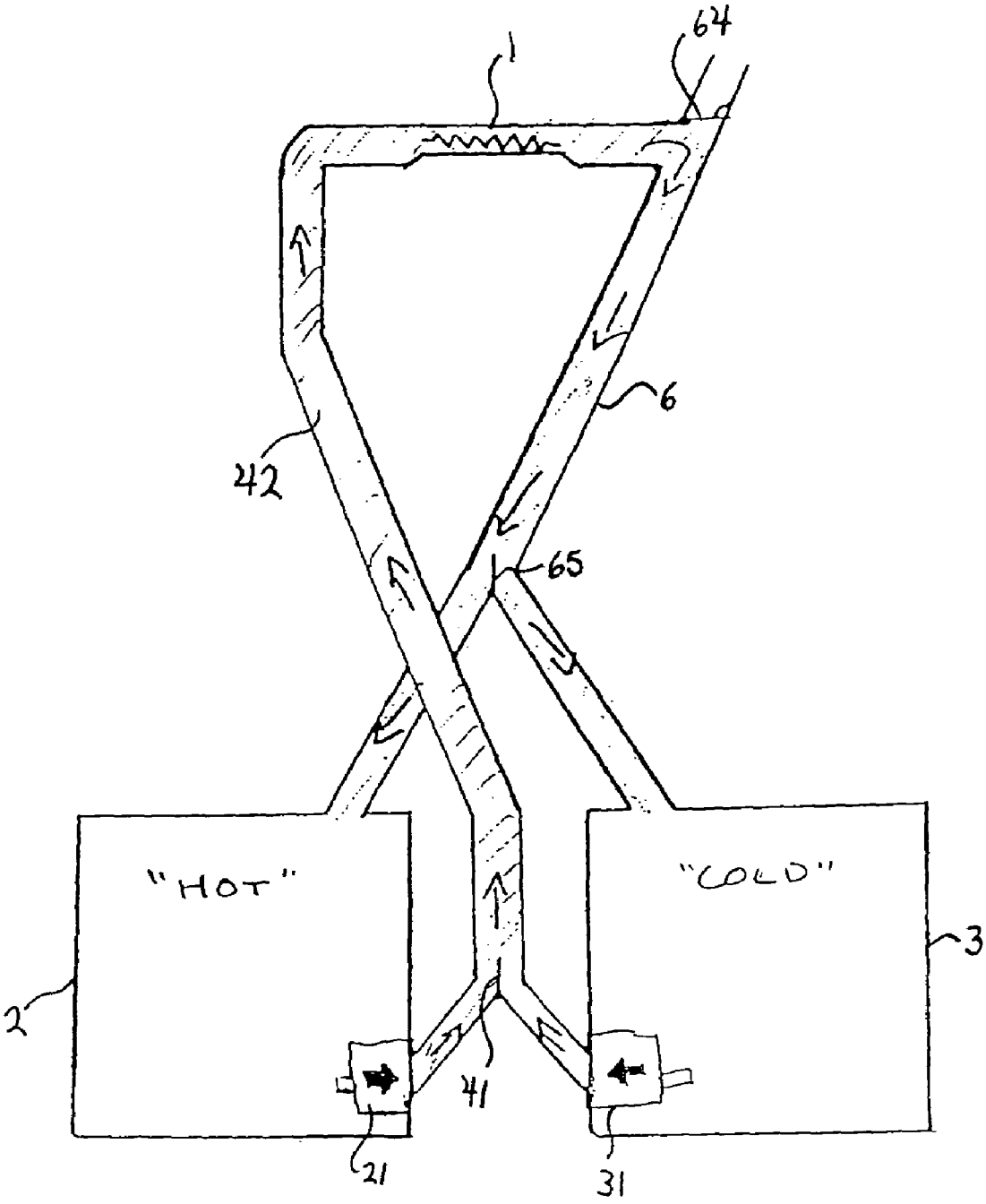
FIG. 5 is a schematic diagram of the heat transfer fluid circulating system in an open configuration, depicting the flow of fluid with both the hot and cold fluid pumps running.

In the open system of FIGS. 4 and 6, only a single one of pumps 21 and 31 was operating at a single time. However, the operation of this system is not confined to the use of a single pump at one time. Rather, both pumps 21 and 31 can operate to send fluid into send tube 42. This operation is effected by the intermediate position of send valve 41 as depicted in FIG. 5. This permits a combination of fluids to achieve a precise temperature of the fluid sent through send tube 42 to heating element 1. The intermediate position of send valve 41 permits equal mixing of the hot and cold fluids. However, this valve can be adjusted very precisely (preferably by microprocessor control) to achieve a particular type of blend for a specific temperature.

Return of heat transfer fluid 15 to either or both of reservoirs 2, 3, is effected by return valve 65. Because of the precise adjustment to achieve and maintain a selected temperature, send valve 41 and return valve 65 are preferably controlled by a microprocessor (depicted in FIG. 9). The operation of both pumps 21, 31 can be carried out when one-way valve 64 is closed, not permitting any additional air or fluid to enter either heater 1 or return tube 6. Without atmospheric adjustment, movement of the fluid is controlled entirely by the action of the pumps 21, 31.

Figure 7:
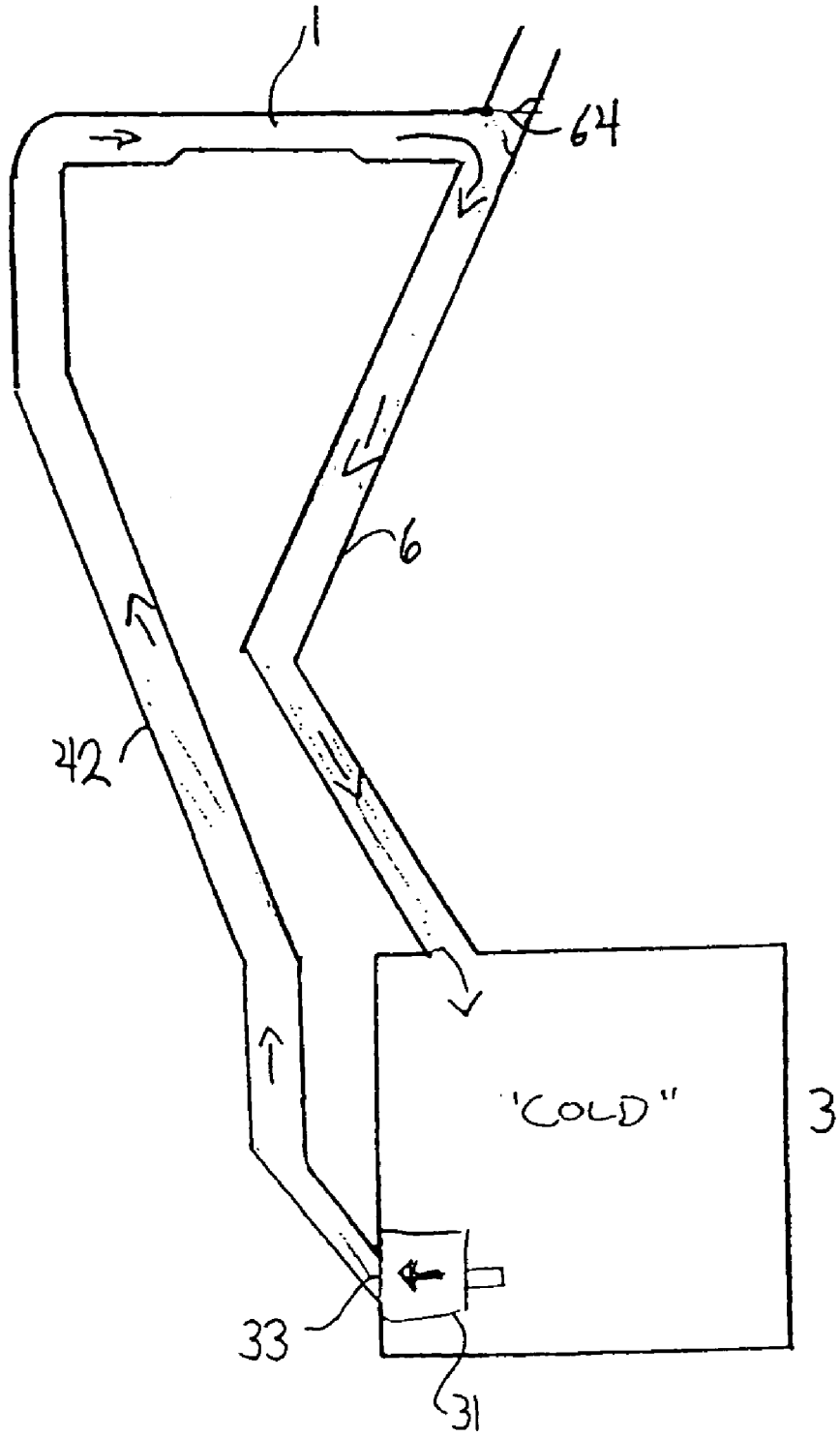
FIG. 7 is a schematic diagram of the heat transfer fluid circulating system for cold heat transfer fluid in an open configuration, and depicting the operation of fluid return using a pump.

While both pumps 21, 31 are operated in the embodiment depicted in FIG. 5, both pumps are not necessary. Rather, the use of only a single reservoir (2 or 3) can be encompassed within the concept of the present invention. Such an arrangement is depicted in FIG. 7. It should be understood that with the embodiments of both FIGS. 5 and 7, one-way valve 64 can permit the entry into the system of additional air, if necessary to facilitate return of fluid to the reservoir. However, this should not be necessary due to the action of either or both of pumps 21, 31. These pumps also make possible the placement of reservoirs 2, 3 above heating element 1. However, such placement, while providing certain advantages in terms of flow to the heating element, also entail certain disadvantages.

FIG. 7 depicts the system of the present invention using only a cold reservoir 2 in an open configuration. In this particular mode of operation, the pump 21 is being used and one-way valve 64 permits entry of air to facilitate the return of the moderating fluid. Also, cold reservoir 3 can be used without the pump, if arranged above heating element 1.

It should be understood that the present invention can utilize either or both of reservoirs 2, 3. It should also be understood that either or both of the reservoirs 2, 3 can be physically positioned above the heating element 1 so that gravity can be used to send the moderating fluid through the heating element. In an open system, it may be possible for air pressure alone to return fluid to a reservoir, as well as sending it through the heating element. In the case of a closed system, a pump will always be needed since valve 64 will always be closed, or might not even exist.

Figure 3:
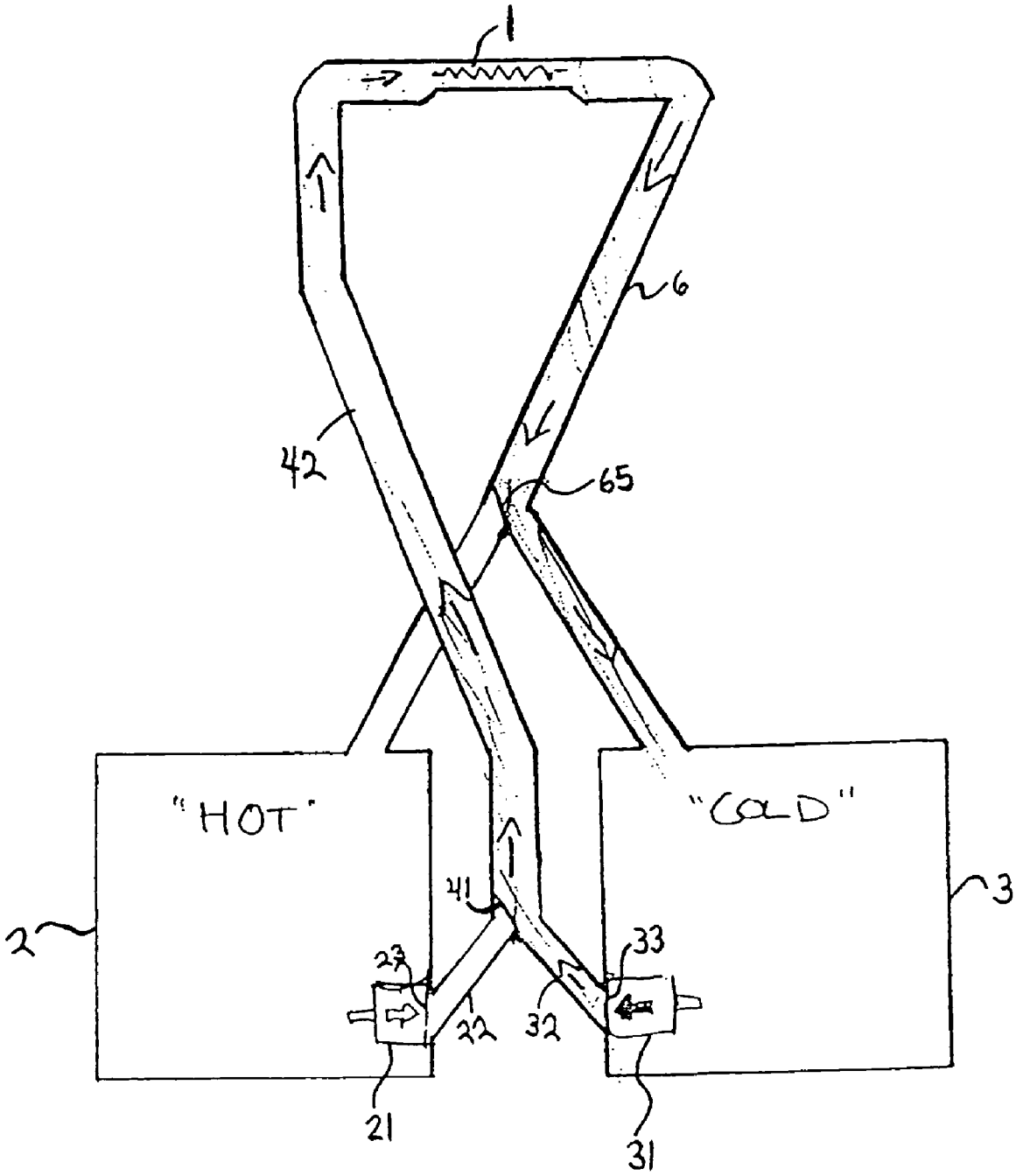
FIG. 3 is a schematic diagram of the heat transfer fluid circulation system, having a closed configuration, and depicting the flow of cooling fluid.
Figure 8:
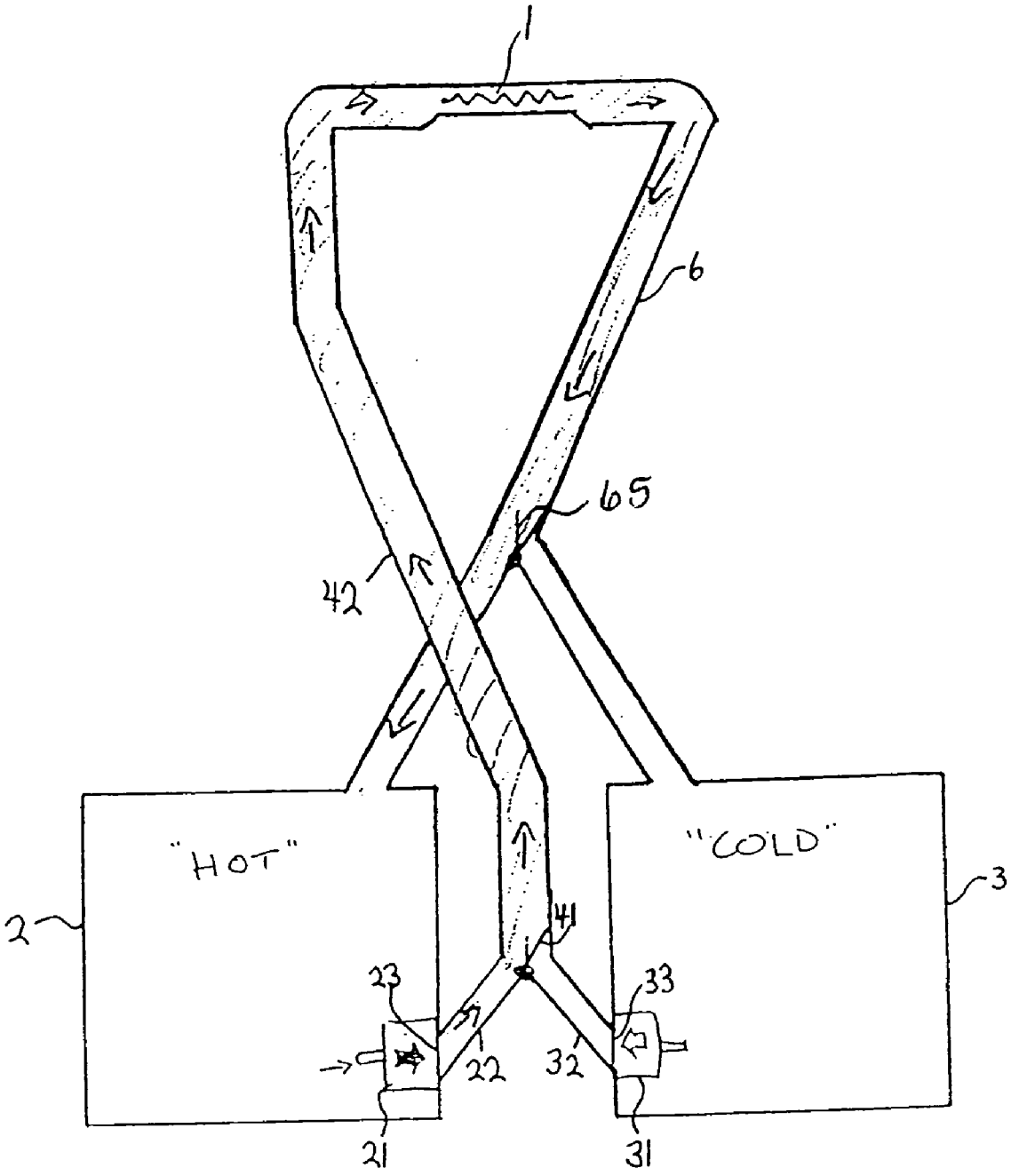
FIG. 8 is a schematic diagram of the heat transfer fluid circulation system in a closed configuration, depicting the operation of the hot heat transfer fluid pump.
Figure 9:
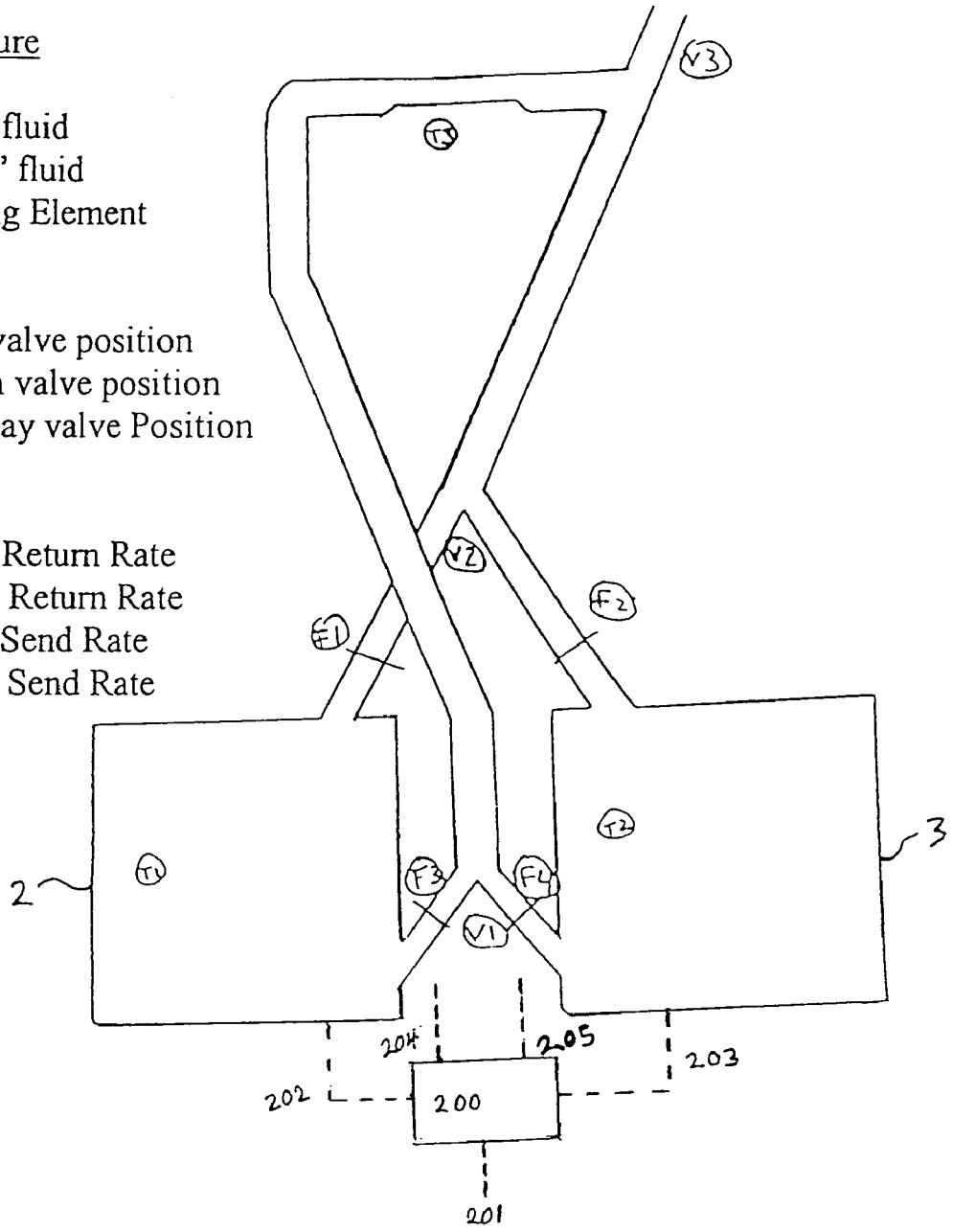
FIG. 9 is a schematic diagram of the heat transfer fluid circulation system, depicting the various sensors, flow meters and valves controlled by a preprogrammed processor.

Closed systems are depicted in FIGS. 3 and 8. In these systems there is no one-way valve 64 to allow additional air or fluid into the system. All movement is dependent upon pumps 21, 31, respectively. FIGS. 3 and 8 are identical except that FIG. 3 depicts the flow of fluid from the cold or ambient reservoir 3 while FIG. 8 depicts the flow of fluid from the hot reservoir 2. In both instances send valve 41 and return valve 65 (as well as valves 23 and 33) are specifically controlled for selection of the fluid to be used. Such selection is carried out by a processor 200, as depicted in FIG. 9, wherein temperature requirements (input by the user) dictate the reservoir selected, as well as valve positions.

In a closed system, as depicted in FIG. 8, when hot fluid is required to be forced through the heating element 1, a pump 21 is activated (and optionally valve 23) to pump the fluid through lead tube 22 and through send tube 42. This forces the fluid which is already in the heating element and the tubes to move back towards the reservoirs (due to the pressure of pump 21). In the arrangement of FIG. 8, the return valve 65 is positioned so as to block the cold reservoir 3 and allow the fluid to return to hot reservoir 2. This prevents the mingling of the hot fluid and the cold fluid.

The same process is carried out when cold heat transfer fluid is required (based upon user instructions, which are entered into microprocessor 200) to rapidly cool heating element 1. This flow of fluid is depicted in FIG. 3. In a closed system, when the heat transfer fluid stops circulating, it remains in place within the system. Consequently, the fluid which is in the heating element 1 remains there. When some fluid from both reservoirs 2, 3 is required, both pumps 21, 31 operate and return valve 65 is positioned to bring fluid back into either or both of the reservoirs.

It should be noted that in any closed system, there is no need for a moderating or heat transfer fluid with a high boiling point. This permits the possibility of using water in a high-heat duty cycle where water might not otherwise be used. The benefits of water are clear, and include easy availability and low cost. Water can be used in a closed system if the system is built to withstand the necessary pressure. For example, a system may be required to be able to contain a pressure of only two atmospheres or less. If the cooking or heating duty cycle requires no more than, for example 300° C., to add to the temperature rise of heating element 1, then water in a closed system can be used as the heat transfer fluid 15. If a greater temperature range is required, other types of heat transfer fluids will be required. Some of these fluids can be used only in a closed system. One advantage of closed systems is that a wider range of moderating or heat transfer fluids can be used.

In complex configurations, and when precise control is wanted by the user, the system of the present invention is operated by a processor 200 (in FIG. 9), having a number of sensor inputs. These sensors monitor the temperature of the heating element 1 and the fluid reservoirs 2, 3. Further, other sensors are used to monitor the position of the valves and the flow rate at various points throughout the system. FIG. 9 depicts the sensor arrangement for a typical system. However, other sensor arrangements can be used within the context of the present invention.

The processor 200 is preferably a microprocessor, but can be a PC or any other programmable input device. Processor 200 can operate to take into account the mass of the heating element, the specific heat of the heat transfer fluid is, and pump either cold, hot or a mix of both into the heating element to quickly bring it to the desired temperature. Further, the overall temperature of the heating element 1 is monitored and the flow rate of the moderating heat transfer fluid 15 adjusted responsive to bring the heating element temperature to that required by the user. Responsive to the temperature demands input by the user, the temperature of the heating element 1, the flow rates and the temperatures of the reservoirs 2, 3 can be adjusted. Further, if there is a rapid alteration in the user's requirements, the processor 200 can respond quickly by altering the entire operation of the system to help bring heating element 1 to the desired temperature as quickly as possible. Accordingly, the present invention would preferably incorporate the control of the electricity from source 7 to the heating element 1 into the control of the heat transfer fluid 15 to obtain a comprehensive temperature control system. It should be understood that the rate at which the pumps 21, 31 operate can also determine the rate at which the heating element 1 temperature increases or decreases.

As depicted in FIG. 9, processor 200 is operatively connected via control harnesses 202, 203 to all the sensors depicted in the system. This provides sensing or monitoring input to the microprocessor. User input device 201 provides the desired operating conditions, most specifically, the desired temperature. Also, the speed at which the temperature is to be achieved can also be input (if the processor is programmed for this and sufficient temperature manipulation is available). Control lines 204 controls the various valves or the valve activators depicted in the other drawings and described previously. Control line 205 is used for adjusting the temperature of the heating element via its main power source 7.

As depicted in FIG. 9, there are three temperature sensors. T1 monitors the fluid temperature in hot reservoir 2. T3 monitors the temperature of the fluid in cold reservoir 3. And T3 monitors the temperature of the heating element. The flow rate is also monitored by sensors to determine how much fluid is flowing at a particular place. F 1 monitors the hot fluid return rate. F2 monitors the cold fluid return rate. F3 monitors the hot fluid send rate. And F4 monitors the cold fluid send rate. The position of the valves is also monitored. Sensor V1 monitors the position of send valve 41. Sensor V2 monitors the position of return valve 65. And sensor V3 monitors the position of one-way valve 64.

Actuators for all of the valves used, including one-way valve 64; return valve 65; send valve 41; and, valves 23 and 33 (if used) are also controlled from processor 200. Also, the heater 24 in heated reservoir 2 can also be controlled along with the amount of electrical power in heating element 1 by processor 200. Further, processor 200 can be used to operate pumps 21, 31, controlling the rate of flow from each of the pumps in order to achieve the desired temperature of the fluid going through heating element 1.

Using processor 200 control, rapid temperature change scenarios are possible. For rapid heating, heater 24 can be maximized along with the high rate of current flow to heating element 11. Pump 21 can also be maximized to create from the highest possible flow of heated fluid to the heating element 1. Any residual liquid in the tubes can be returned to the ambient reservoir 3 in order to minimize the heat lost by the return of cold fluid to the heated reservoir 2. Because the processor 200 is detecting the temperature of the overall system, especially heating element 1, a determination can be made when the heating will stop (based upon a user-entered command), and the time at which the heated transfer of fluid is no longer necessary.

Once the user-specified temperature is reached, the overall system, guided by microprocessor 200, must operate to maintain a steady state until new user instructions are received by microprocessor 200. Maintaining the temperature is merely a matter of a simple feedback control algorithm that can be programmed into microprocessor 200. The program can respond to changes in the system, including the lower temperature in the heating element 1, due for example, to a large cold mass being applied to the heating element. The temperature can be raised automatically by activating the power source to the heating element to increase the amount of power to the heating element. Also, the system can send more hot fluid into the heating element to immediately compensate for any heat drain on the heating element.

Rapid cool-down of a heating element can be effected in very much the same way as rapid heating. The power to the heating element 1 is immediately cut and water from ambient or cool reservoir 3 is pumped as quickly as possible to clear any warm water out of the heating element and tubing. In many cases, the temperature is simply lowered (so that the cooking vessel can remain on the heating element 1 without burning). In such case, the desired lower temperature will determine the point at which it is no longer necessary to continue cooling the heating element.

It should be understood that a mixing chamber 4 as depicted in FIG. 1 can be used to obtain a heat transfer fluid 15 at a specific temperature. This fluid can then be pumped (using one or both of pumps 21, 31) so that fluid of a specific temperature can be run through heating element 1. Further, the valve configuration of FIGS. 2–9 can be altered within the concept of the present invention. Likewise, the configuration of sensors can also be altered from that represented in the drawings. The wide variety of different control configurations and programming for processor 200 can be used to carry out the process of the present invention. Further, a wide variety of heating and cooling devices can be used at various points throughout the system. For example, heating or cooling elements can be placed on any of the tubes from the two reservoirs to the heating element 1. Accordingly, virtually any configuration of valves and sensors can be used to carry out the operation of the present invention.

A clear advantage of the present invention is to allow very rapid and very accurate temperature control of the heating element 1. This can be effected in a number of different ways depending upon how processor 200 is programmed. The programming will be carried out in accordance with the system demands specified by the user and the heating and cooling capability built into the overall system. Such capability can be very widely based upon the cost and complexity selected by the designer or manufacturer of the system.

It should be understood that the present embodiments have been confined to electric stove cooking tops or "burners." However, the present invention can also be applied to ovens, broilers, warming plates, and the like. The present invention can be applied in any situation where more rapid heating or more rapid cooling of any electric heating element is desired.

While a number of embodiments have been disclosed by way of example, the present invention is not limited thereby. Rather, the present invention should be construed to include any and all variations, adaptations, permutations, derivations, modifications, and embodiments that would occur to one skilled in this art having been taught the present invention. Accordingly, the present invention should be understood to be limited only by the following claims.

I claim:

1. A system for controlling heating of at least one electric stove heating element which is energized by an external electric power source, said heating element having a hollowed portion and an integral electric conductor connected to said external electric power source for providing electrical energy to be converted to heat, said system comprising:

(a) at least one reservoir containing a heat transfer fluid; and, (b) handling means for moving said heat transfer fluid from said at least one reservoir through said hollow portion and back to said at least one reservoir.

2. The system of claim 1, further comprising at least one additional reservoir, wherein at least one of said reservoirs contains cool heat transfer fluid, and at least one of said reservoirs contains heated heat transfer fluid.

3. The system of claim 2, further comprising a separate electric heater arranged to heat said heat transfer of fluid in said at least one heated reservoir.

4. The system of claim 3, wherein said handling means for moving said heat transfer fluid comprises at least one pump in at least one of said reservoirs.

5. The system of claim 4, wherein said handling means for moving said heat transfer fluid further comprises a circulating system for said heat transfer fluid.

6. The system of claim 5, wherein said circulating system comprises a plurality of valves.

7. The system of claim 6, wherein said circulating system further comprises a plurality of sensors arranged to detect at least one of heat transfer fluid temperature, and heat transfer fluid flow rate at various parts of said circulating system.

8. The system of claim 7, further comprising:

(c) A processor programmed to receive input from a user, and from said sensors.

9. The system of claim 8, wherein said processor is programmed to control said valves, said at least one pump, and said at least one heater.

10. A method of adjusting temperature of an electric stove heating element which is energized by a primary external power source, and temperature moderated by an external temperature-controlled heat transfer fluid, said method comprising the steps of:

(a) selecting a desired temperature for said heating element, (b) adjusting power from said primary external electric power source to alter temperature of said heating element, (c) flowing said heat transfer fluid through said heating element to further alter temperature of said heating element; and, (d) detecting an altered temperature of said heating element and comparing said altered temperature to said desired temperature.

11. The process of claim 10, wherein said step (a) of selecting a desired temperature is carried out by inputting data to a processor.

12. The process of claim 11, further comprising the step of:

(e) adjusting at least one of said primary external electric power source, temperature of said heat transfer fluid and flow rate of said heat transfer fluid, responsive to a comparison of said altered temperature and said desired temperature.

13. The process of claim 12, wherein step (c) of providing said heat transfer fluid comprises operating valves in a circulating system carrying said heat transfer fluid.

14. The process of claim 13, wherein step (e) of adjusting further comprises mixing said heat transfer fluid from different reservoirs maintained at different temperatures.

* * * * *